US008332988B2

(12) United States Patent
Sweeney et al.

(10) Patent No.: US 8,332,988 B2
(45) Date of Patent: Dec. 18, 2012

(54) PAINT ROLLER GUIDE

(75) Inventors: Danny Sweeney, Apex, NC (US); Michael M. Sherman, Mooresville, NC (US)

(73) Assignee: Zibra, LLC, Mooresville, NC (US)

( * ) Notice: Subject to any disclaimer, the term of this patent is extended or adjusted under 35 U.S.C. 154(b) by 90 days.

(21) Appl. No.: 12/958,464

(22) Filed: Dec. 2, 2010

(65) Prior Publication Data

US 2011/0131745 A1 Jun. 9, 2011

Related U.S. Application Data

(60) Provisional application No. 61/283,466, filed on Dec. 4, 2009.

(51) Int. Cl.
*B05C 17/02* (2006.01)

(52) U.S. Cl. ..... 15/230.11; 15/248.2

(58) Field of Classification Search ..... 15/230.11, 15/248.1, 248.2
See application file for complete search history.

(56) References Cited

U.S. PATENT DOCUMENTS

| | | | | |
|---|---|---|---|---|
| 3,088,152 | A * | 5/1963 | Lucas | 15/230.11 |
| 3,790,984 | A * | 2/1974 | Spransy et al. | 15/248.2 |
| 5,463,789 | A * | 11/1995 | Zilinski | 15/248.2 |
| D456,146 | S * | 4/2002 | Ver Haar | D4/199 |

* cited by examiner

*Primary Examiner* — Shay Karls
(74) *Attorney, Agent, or Firm* — Tillman Wright, PLLC; Chad D. Tillman

(57) ABSTRACT

A roller guide assembly is attached to a paint roller frame to maintain a consistent space between a surface adjacent to the surface being painted and a roller cover carried by the roller frame. The roller guide assembly includes a guide arm attached to a vertical portion of the roller frame and a mounting clamp that that fits on the roller frame. The mounting clamp uses an adjustable locking screw and tightening knob to secure the mounting clamp to the roller frame. The mounting clamp has a cavity configured to receive the guide arm such that the guide arm extends past the roller cover. The roller guide assembly also has a storage clip mounted on the roller frame for temporarily storing the guide arm while the roller cover is being reloaded with paint. The guide arm mounts to the roller frame between a first bend extending from a shank that extends from a cage section of the roller frame that receives the roller cover and before a second bend that bends back to meet a handle grip of the roller frame.

11 Claims, 2 Drawing Sheets

PAINT ROLLER GUIDE

CROSS REFERENCE TO RELATED APPLICATIONS

This application claims the priority benefit of U.S. Provisional Patent Application Ser. No. 61/283,466 filed Dec. 4, 2009.

BACKGROUND OF THE INVENTION

1. Field of the Invention

This invention relates to an apparatus useful in painting applications, and more specifically to an attachment for paint roller frames for providing protection against unintended bumping into the ceiling or ceiling molding with the wet roller when painting walls, and to provide a consistent distance from ceiling trim or the ceiling which allows the user to eliminate the step of "taping out" the trim or ceiling with painters tape prior to painting the walls.

2. Description of Related Art

There are a variety of paint roller frames for painting of walls with the most popular of such being a "cage frame" using bent wire shaped into a boxed c-frame shape or an angled frame shape. In each such design, there typically exists a vertical portion of the bent frame between the shank that extends from the cage section and before the wire bends back to meet the handle grip. Typically, this vertical section ranges in length from slightly more than 1 inch to over 3 inches. Such roller frames come in a range of sizes (noted by width of the cage or shank) from 3 inches to 12 inches, with 9 inches being a standard in most countries around the world. When a roller cover having a diameter from about 1/2 inch to about 4 inches is inserted onto the frame, the nap or fabric of the roller cover spins freely around the frame.

These types of paint roller frames all have a common deficiency—they allow the user to accidentally bump the ceiling or ceiling trim when painting adjacent walls. Such accidental bumping of the ceiling often creates the need for a full repainting of the ceiling or ceiling trim molding leading to lost productivity, time, and money and increased frustration for both the professional or casual painter. The potential to accidentally bump the ceiling is further increased when using an extension pole connected to the frame handle, as the user's line of sight is impaired when the roller cover is at heights above the user height, making it more difficult to judge the paint safety zone from the ceiling or trim.

Thus, there is a need for a paint frame apparatus that would provide greater utility and convenience to allow the user to paint the wall with consistent spacing from ceiling trim or from the ceiling and to prevent accidental bumping of same with a paint-charged roller.

SUMMARY OF THE INVENTION

The invention is directed to a roller guide assembly for use with a paint roller frame to maintain a consistent space between a surface adjacent to the surface being painted and a roller cover carried by the roller frame. The roller guide assembly includes a guide arm attached to a vertical portion of the roller frame and a mounting clamp that that fits on the roller frame. The mounting clamp uses an adjustable locking screw and tightening knob to secure the mounting clamp to the roller frame. The mounting clamp has a cavity configured to receive the guide arm such that the guide arm extends past the roller cover. The roller guide assembly also has a storage clip mounted on the roller frame for temporarily storing the guide arm while the roller cover is being reloaded with paint. The guide arm mounts to the roller frame between a first bend extending from a shank that extends from a cage section of the roller frame that receives the roller cover and before a second bend that bends back to meet a handle grip of the roller frame.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
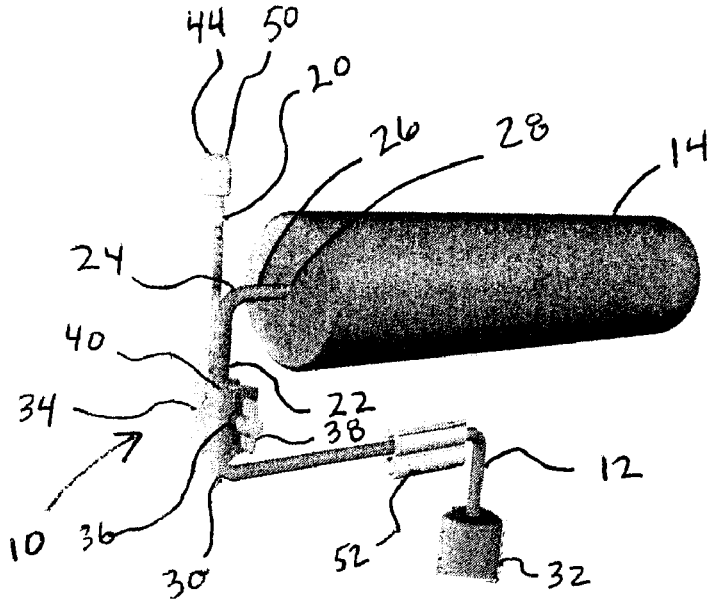
FIG. 1 is a perspective view of a paint roller frame having a guide assembly according to one embodiment of the invention.
Figure 2:
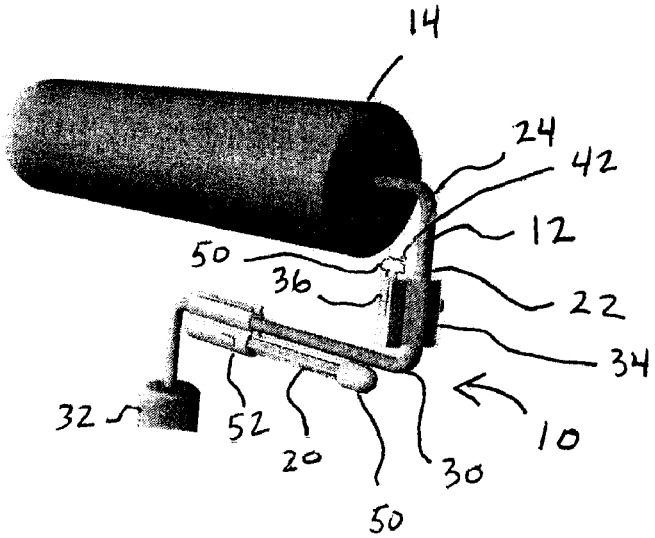
FIG. 2 is a perspective view of the guide assembly of FIG. 1 in a storage position.

Referring now to the Figures, FIG. 1 illustrates a roller guide assembly 10 for use with conventional paint roller frames 12. As is known in the art, the paint roller frame 12 receives a roller cover 14 used to transfer paint to the surface being painted. As will be explained below, the roller guide assembly 10 maintains a consistent space between the ceiling or ceiling trim molding and the wet roller cover 14 used to paint the adjacent wall. The paint roller frame 12 illustrated is a conventional wire-type cage frame, however, one skilled in the art will understand that the roller guide assembly 10 is configured to work with a wide variety of roller frames 12 found on the market.

The roller guide assembly 10 includes a guide arm 20 attached to a vertical portion 22 of the roller frame 12 between first bend 24 extending from a shank 26 that extends from a cage section 28 and before a second bend 30 that bends back to meet a handle grip 32. The guide arm 20 is attached with a mounting clamp 34 that that fits on the roller frame 22. Desirably, the mounting clamp 34 is sized to work with diameters of roller frame wire ranging from about 6 mm to 9 mm, although other sizes are contemplated. In one embodiment, the mounting clamp 34 has an adjustable locking screw 36 and tightening knob 38 that secures the mounting clamp 34 to the vertical portion 22 of the roller frame 12. The locking screw 36 maintains a secure frictional fit between the mounting clamp 34 and the roller frame 12 within the vertical portion 22 of the roller frame 12. The tightening knob 38 can be of any type or style but preferably molded to a grip style that allows for easy turning of the locking screw. An inside cavity 40 of the mounting clamp 34 may include an additional material insert such as rubber to provide added grip hold. However, one skilled in the art will understand that other means for securing the mounting clamp 34 to the roller frame 12 may be used using sound engineering judgment without departing from the scope of the invention.

Figure 3:
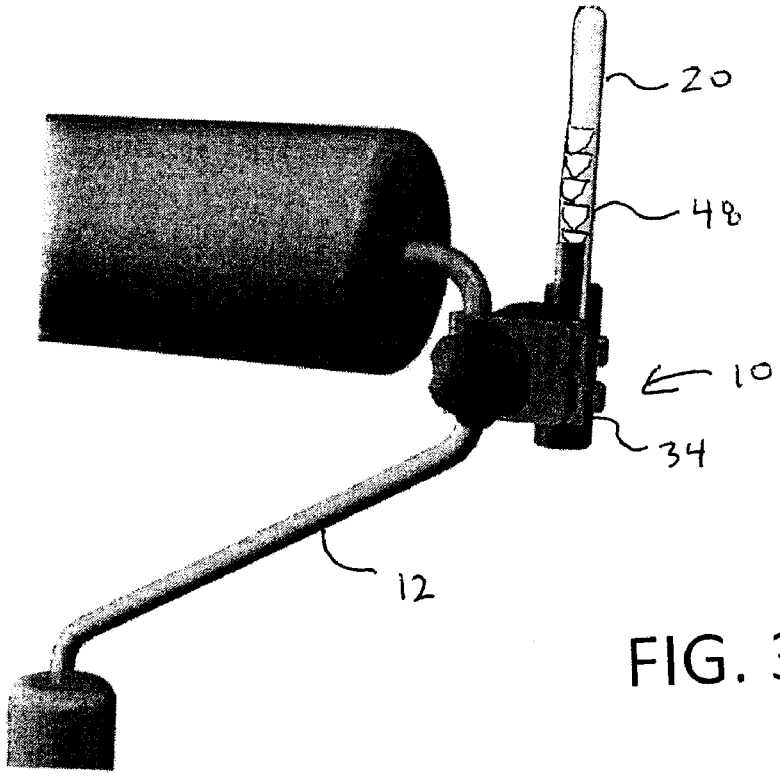
FIG. 3 is a perspective view of the guide assembly according to another embodiment of the invention.

The guide arm 20 is received in a vertical cavity 42 of the mounting clamp 34 and extends therefrom in a general direction such that it extends past the nap of the roller cover 14 received on the roller frame 12. The guide arm 20 has a desirable length from about 2 inches to about 6 inches so that when it is received into the vertical cavity 42 of the mounting clamp 34 the guide arm 20 extends vertically above the roller cover 14 in a direction perpendicular to the longitudinal axis of the roller cover 14 to provide a desirable clearance from the ceiling or ceiling trim. The actual clearance distance created between a tip 44 of the guide arm 20 and the nap of the roller cover 14 may be controlled and set by the user by adjusting the mounting clamp 34 on the vertical portion 22 of the roller frame 12 either higher or lower. The range of the mounting clamp 34 and movement is determined by the length of vertical portion 22 of the roller frame 12. Alternately, as shown in FIG. 3, the guide arm 20 may include a series of teeth 48 that engage the mounting clamp 34 to adjust the length of the guide arm 20 extending from the vertical cavity 42 of the mounting clamp. In one embodiment, the guide arm 20 is inserted from the bottom of the vertical cavity 42 and pushed through the mounting clamp 34 to engage the teeth 48 until the tip 44 of the guide arm 20 is at the desired position. In one embodiment, the guide arm 20 has a plastic or rubber cap 50 that protects the ceiling or trim from being scratched if bumped by the tip 44.

Figure 4:
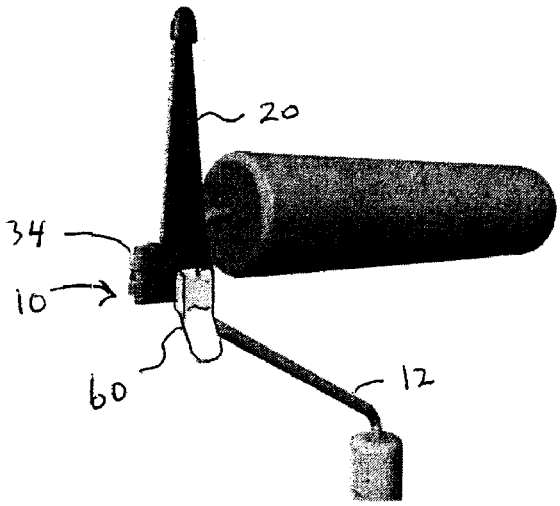
FIG. 4 is a perspective view of the guide assembly according to another embodiment of the invention.

When loading the roller cover 14 with paint from a tray system, it is desirable to remove the guide arm 20 from the vertical cavity 42 of the mounting clamp 34 to keep it from dipping into the paint well. The roller guide assembly 10 also includes a storage clip 52 that enables the user to temporarily store the guide arm 20. This storage clip 52 is desirably mounted in a horizontal or angled section of the roller frame 12 above the frame grip handle 32. The storage clip 52 may attach to the roller frame 12 with a locking screw, be clipped on the roller frame 12, or mounted with other means using sound engineering judgment. The guide arm 20 stores in a cavity in the storage clip 52 while the roller cover 14 is reloaded with paint. To prevent paint from entering the vertical cavity 42 of the mounting clamp 34, a plastic or rubber cap seals the vertical cavity 42 when the guide arm 20 is removed. Alternately, as illustrated in FIG. 4, the mounting clamp 34 may include a friction lever 60 that when flipped to a loosened state, allows the guide arm 20 to pivot away from the roller cover 14.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

The invention claimed is :

1. A roller guide assembly for use with a paint roller frame to maintain a consistent space between a surface adjacent to the surface being painted and a roller cover carried by the roller frame, the roller guide assembly comprising:

a guide arm;

a mounting clamp attachable to the roller frame and comprising a cavity configured to receive therein and position the guide arm such that the guide arm extends past the roller cover in a direction perpendicular to the longitudinal axis of the roller cover; and a storage clip mountable on the roller frame and configured to temporarily store the guide arm when the guide arm is not received in and positioned by the cavity of the mounting clamp.

2. The roller guide assembly of claim 1 wherein the guide arm mounts to the roller frame between a first bend extending from a shank that extends from a cage section of the roller frame that receives the roller cover and before a second bend that bends back to meet a handle grip of the roller frame.

3. The roller guide assembly of claim 2 wherein the storage clip mounts in a horizontal or angled section of the roller frame above the frame grip handle.

4. The roller guide assembly of claim 1 wherein the mounting clamp has an inside cavity having a rubber insert to provide added grip.

5. The roller guide assembly of claim 1 wherein the guide arm has a length from about 2 inches to about 6 inches.

6. The roller guide assembly of claim 1 wherein the clearance distance created between a tip 44 of the guide arm 20 and the nap of the roller cover 14 may be controlled and set by the user by adjusting the mounting clamp 34 on the vertical portion 22 of the roller frame 12 either higher or lower.

7. The roller guide assembly of claim 1 wherein the guide arm comprises a series of teeth that engage the mounting clamp to adjust the length of the guide arm extending from the vertical cavity, wherein the guide arm is inserted from the one end of the vertical cavity and pushed through the mounting clamp until the tip of the guide arm is at the desired position.

8. The roller guide assembly of claim 1 wherein the guide arm has a plastic or rubber cap on the tip.

9. The roller guide assembly of claim 1 wherein the mounting clamp is sized to work with diameters of roller frame wire ranging from about 6 mm to 9 mm.

10. The roller guide assembly of claim 1 wherein the mounting clamp comprises an adjustable locking screw and tightening knob that secures the mounting clamp to the roller frame.

11. A paint roller comprising:

a paint roller frame;

a roller cover carried by the roller frame;

a mounting clamp attached to the roller frame;

a storage clip attached to the roller frame; and a guide arm selectively mountable to the mounting clamp and to the storage clamp, the mounting clamp comprising a cavity in which the guide arm is received and positioned such that the guide arm extends past the roller cover when the guide arm is attached to the mounting clamp, and the storage clamp temporarily storing the guide arm for reloading the roller cover with paint.

* * * * *